United States Patent [19]

Godel et al.

[11] 3,934,114

[45] Jan. 20, 1976

[54] HAIR STYLING DEVICE HAVING VAPOR GENERATING MEANS

[75] Inventors: Siegfried Godel, Norwalk; James J. Viola, Milford, both of Conn.

[73] Assignee: Sperry Rand Corporation, Bridgeport, Conn.

[22] Filed: June 20, 1974

[21] Appl. No.: 481,215

[52] U.S. Cl. ..... 219/222; 132/32 R; 132/33 R; 132/37 R; 219/225; 219/241; 219/273; 219/533

[51] Int. Cl.² ... H05B 1/00; A45D 1/02; A45D 2/36

[58] Field of Search ..... 219/222–226, 219/271–276, 362, 533, 221, 227–241; 132/7, 9, 31 R, 32 R, 33 R, 34, 36 R, 37 R, 37 A, 112, 117, 118; 128/186, 192; 21/117–120; 239/132–136, 49, 50; 38/69, 71; 223/51

[56] References Cited

UNITED STATES PATENTS

| | | | |
|---|---|---|---|
| 1,449,288 | 3/1923 | Killen | 219/225 X |
| 1,510,359 | 9/1924 | Van Gale | 132/41 C |
| 1,591,806 | 7/1926 | Dahlem | 132/37 R |
| 1,894,751 | 1/1933 | Baum | 219/225 X |
| 1,904,043 | 4/1933 | Frank et al. | 132/37 R |
| 2,065,874 | 12/1936 | Salvio | 132/41 C |
| 2,104,212 | 1/1938 | Taylor | 239/50 |
| 2,244,180 | 6/1941 | Williams et al. | 219/273 |
| 2,935,070 | 5/1960 | Auz | 219/222 X |
| 3,220,421 | 11/1965 | VanDroogenbroek et al. | 219/222 UX |
| 3,622,746 | 11/1971 | Trouilhet | 219/241 X |
| 3,703,042 | 11/1972 | Smith | 38/69 |
| 3,770,183 | 11/1973 | Vamyi | 219/238 UX |
| 3,835,292 | 9/1974 | Walter | 219/222 |

*Primary Examiner*—A. Bartis
*Attorney, Agent, or Firm*—Charles R. Miranda

[57] ABSTRACT

An electric hair curling iron having vapor generating means includes a handle portion having an elongated hair curling body extending from an end thereof. Stationary thermostatically controlled electric heating element and a movable heat conducting means in heat exchange relation therewith are arranged in the body. A liquid reservoir is supported at the end of the hair curling body and includes liquid transfer wick spaced from the heat conducting means to define therebetween a vaporization space. Actuator means are provided on the handle for selectively moving the heat conducting means into and out of engagement with the wick to effect generation of vapor in the vaporization space. The vapor produced is passed exteriorly through openings in the body into contact with the hair wound on the curling body.

7 Claims, 11 Drawing Figures

HAIR STYLING DEVICE HAVING VAPOR GENERATING MEANS

BACKGROUND OF THE INVENTION

This invention is directed to new and useful improvements in hair styling apparatus and in particular to hand-held electrically heated curling irons having vapor generating means.

Electric curling irons for styling and setting the hair of the user are well-known. Certain of these devices include elongated casings having one end comprising the handle portion and the opposite end provided with a cylindrical shaped heated operative portion. Clamp or clip means are usually provided on the casing which are pivoted to the handle and function upon manipulation of the pivoted end thereof to clamp a tuft or lock of hair to the heated portion of the iron. The curling iron is then rotated in the hand of the user to wind the hair about the iron with the heat of the iron causing the formation of the curl when the hair is released from the implement.

As mentioned in certain of these devices means are provided for emitting the vapor such as through openings in the heated portion of the iron and which vapor assists in forming a more soft and well-shaped curl. Typical of the prior art devices for accomplishing these ends include reservoir means in the handle portion of the instrument for storing the liquid to be vaporized. Hand-operated valve means are provided for releasing the liquid from the handle to the heated element for causing vapor to be generated when the liquid contacts the heated element. In other devices the liquid reservoir is provided in the forward end of the casing and is provided with an absorbent wick which is adapted to be moved into contact with the heated element within the casing for generating vapor preferably steam. In these known devices excessive manipulation of the casing and associated parts thereof is required to obtain the desired vaporization which causes general inconvenience to the user. Further disadvantages of these known type devices is that the location and structure of the vapor generating means results in less efficient heating of the implement.

It is an object of the present invention to provide a novel hair styling device.

It is a further object to provide a novel electric hair curling iron having novel means for generating and emitting vapor such as steam therefrom.

A further object is to provide a novel steam hair curler iron having a novel heat and steam generating means which include a novel actuator arrangement in the casing for effecting the steam generation.

A further object is to provide a novel hair styling appliance which includes novel electrical cord connector means to allow for swiveling rotation of the implement in the hand of the user without interference with the appliance power cord.

A still further object is to provide a novel hair styling device that results in more efficient assembly procedure effecting a cost in both savings and in parts.

SUMMARY OF THE INVENTION

The present invention contemplates a novel hand-held electric curling iron having vapor generating means preferably steam, within an elongated casing comprising a handle portion and an operative heated portion extending therefrom. A hair clip or clamp is provided intermediate the ends of the iron and is adapted for pivotable movement toward and away from the operative end of the iron to selectively clamp and unclamp hair to the outer surface of the operative end. A liquid reservoir is provided at one end of the casing having an absorbent wick projecting into the casing. Heat transfer means are provided in the casing in association with the means for heating the iron. Actuator means are provided on the handle to cause movement of the heat transfer means into contact with the wick for generating steam upon contact. The generated steam escapes through openings in the iron to the hair wrapped about the operative end. Novel power cord connector means are also provided in the handle for transmitting current to the heat and steam generating means and which connector means permit rotation of the handle member without interference with the power cord.

These above and other objects and advantages of the present invention will appear more fully hereinafter from a consideration of the detailed description which follows taken together with the accompanying drawings wherein one embodiment is illustrated.

DETAILED DESCRIPTION

Figure 1:
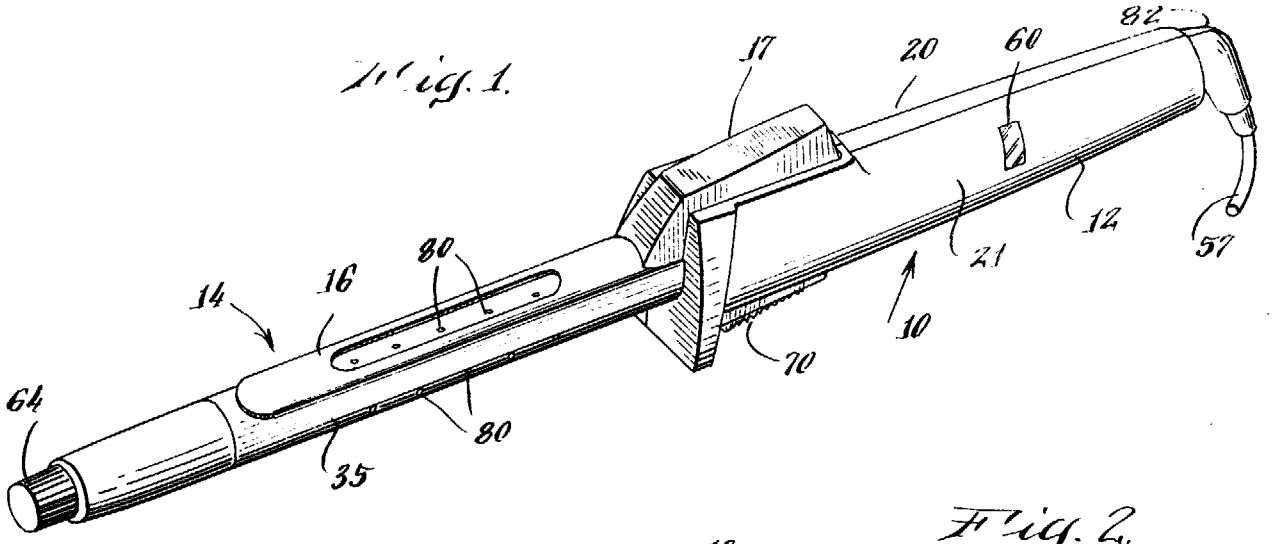
FIG. 1 is a perspective view of a hair curling iron device embodying the present invention.
Figure 2:
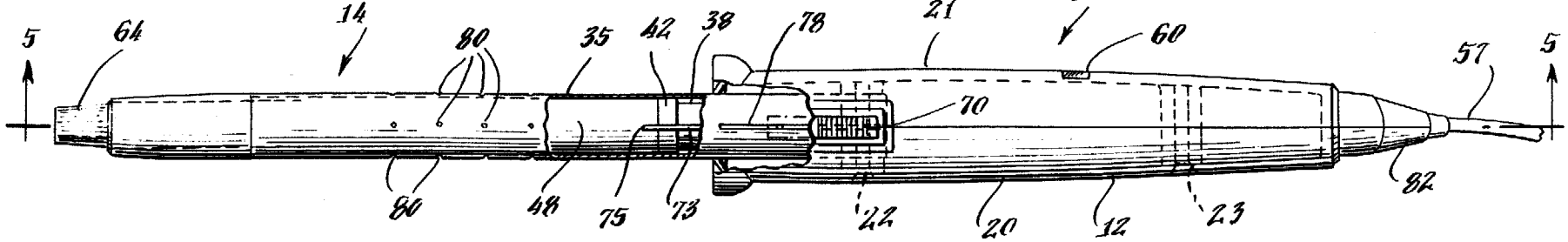
FIG. 2 is a bottom view of the device of FIG. 1 with parts broken away to show interior portions of the device.
Figure 3:
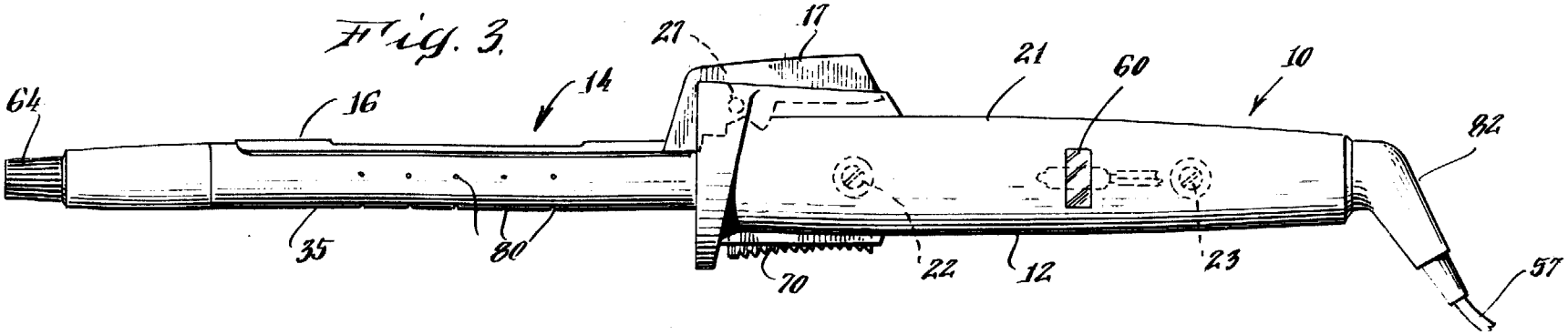
FIG. 3 is a side longitudinal view of the implement of FIG. 1.
Figure 4:
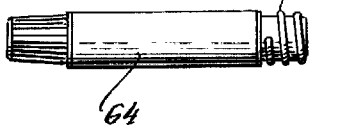
FIG. 4 is a view of the liquid reservoir or container removed from the operative end of the curler iron.

Referring now to the drawings for a more detailed description of the present invention, a hair curling iron in which is contained one embodiment of the present invention is generally indicated by the reference numeral 10 in FIGS. 1, 2, 3 inclusive. Iron 10 includes a casing comprising a handle portion 12 from which extends an operative end portion 14. A hair clip 16 is pivotally mounted on handle 12 whereupon manipulation of a depressible button 17 a lock of hair may be clamped to operative end 14 of iron 10. Manual rotation of the iron 10 wraps the hair about end 14. Heat emitted from end 14 in a manner to be explained causes a curl to be formed. The reverse rotation of iron 10 permits release of the curl from clamp 16 in a usual well-known manner.

Handle portion 12 is made of a suitable hard plastic material comprising complementary formed casing sections 20–21 which are held in assembled mated relationship by a suitable fastening means such as spaced threaded fasteners 22–23.

Figure 5:
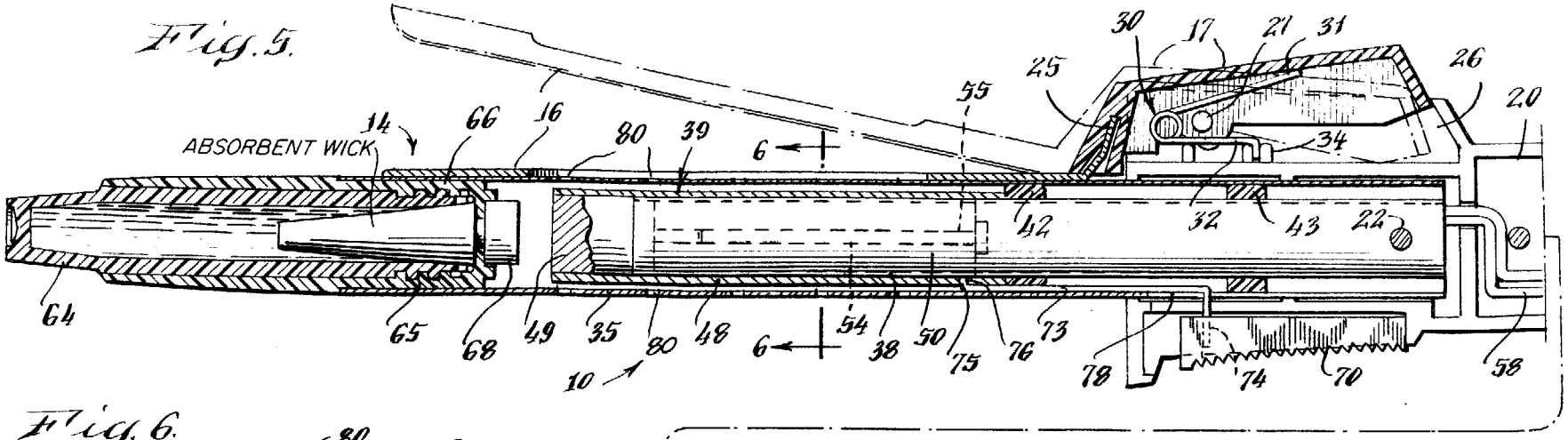
FIG. 5 is an enlarged sectional view taken longitudinally of the entire length of the hair curler iron of FIG. 4 showing portions of the inner structure thereof.

The hair clamp 16 includes a metal semi-cylindrical member conforming to the outer surface of operative end 14. A bent end 25 (FIG. 5) of clamp 16 is press-fitted within a recess of button 17 (FIG. 5). Button 17 is disposed within a cavity 26 of handle 12 formed by the mating of sections 20 and 21. Projections 27 on the walls of cavity 26 (FIGS. 9–10) are fitted within openings 28 in the depending sidewalls of button 17 (FIG. 10) to provide a pivot therefor. A torsion spring 30 is disposed within button 17 and has one arm 31 bearing against the under surface thereof and the end of the other arm 32 fitted within projections 34 of the bottom wall of cavity 26. As will be appreciated the depression of button 17 (FIG. 9) in cavity 26 about pivot members 27–28 will cause clamp 16 to pivot against the urging of spring 30 away from operative end portion 14 of iron 10. Upon release of button 17 clamp 16 is restored by spring 30 against the surface of operative end portion 14.

Operative end 14 of iron 10 includes an elongated metallic cylindrical casing 35 which extends into handle 12 between mated sections 20 and 21. Cylindrical casing 35 is held securely in handle 12 by the engagement of sections 20 and 21 and screw fastener 22 which extends through one end thereof. Additional suitable means (not shown) are provided on the forward end of handle 12 to position casing 35 therein in a usual manner.

Figure 8:
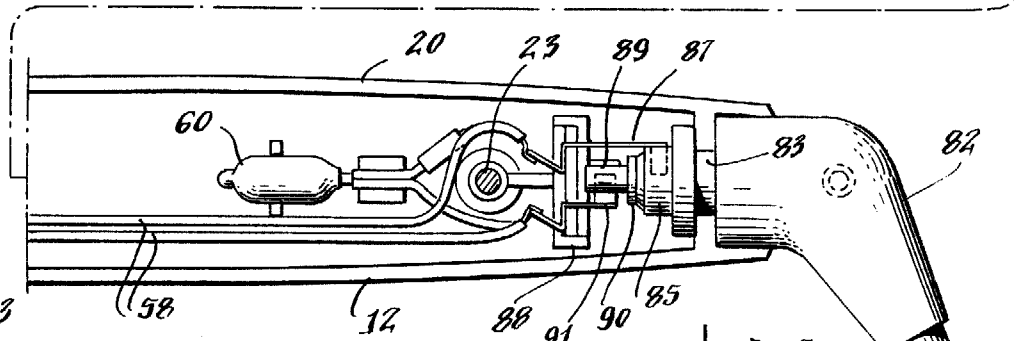
FIG. 8 is a sectional view taken on the line 8—8 of FIG. 7.
Figure 8:
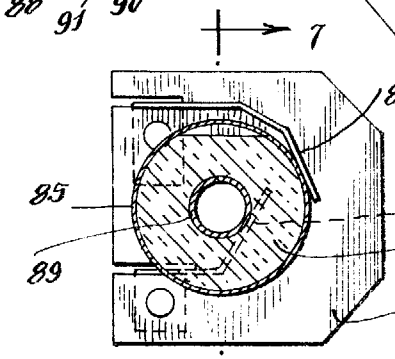
Figure 6:
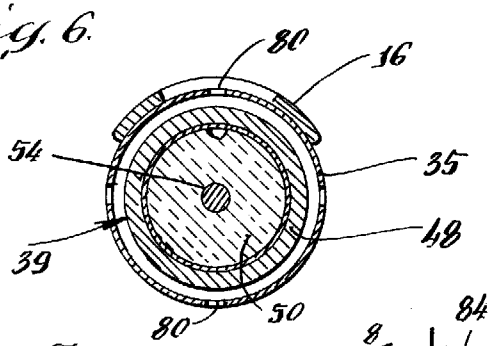
FIG. 6 is a sectional view taken on the line 6—6 of FIG. 5.
Figure 7:
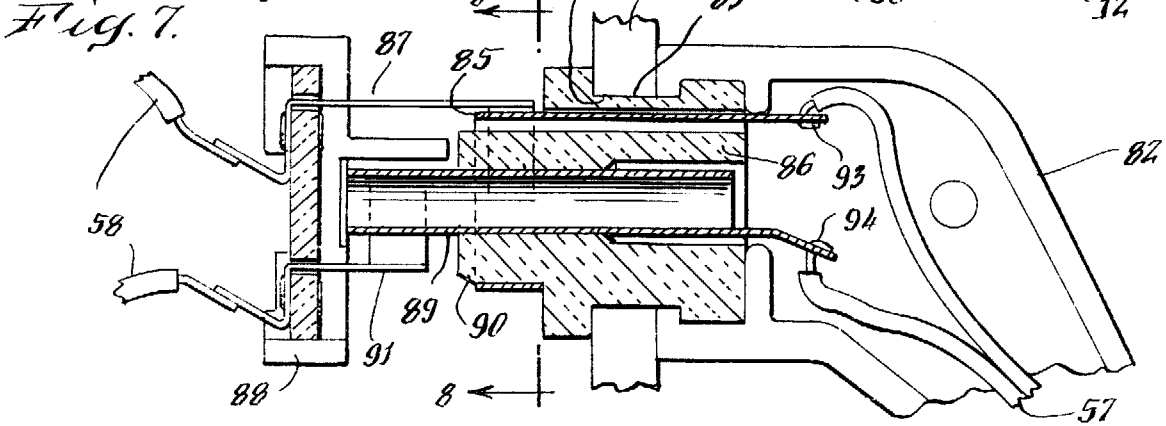
FIG. 7 is an enlarged sectional view of the power cord end connection and terminal contacts within the device taken on the line 7—7 of FIG. 8.
Figures 9, 10, 11:
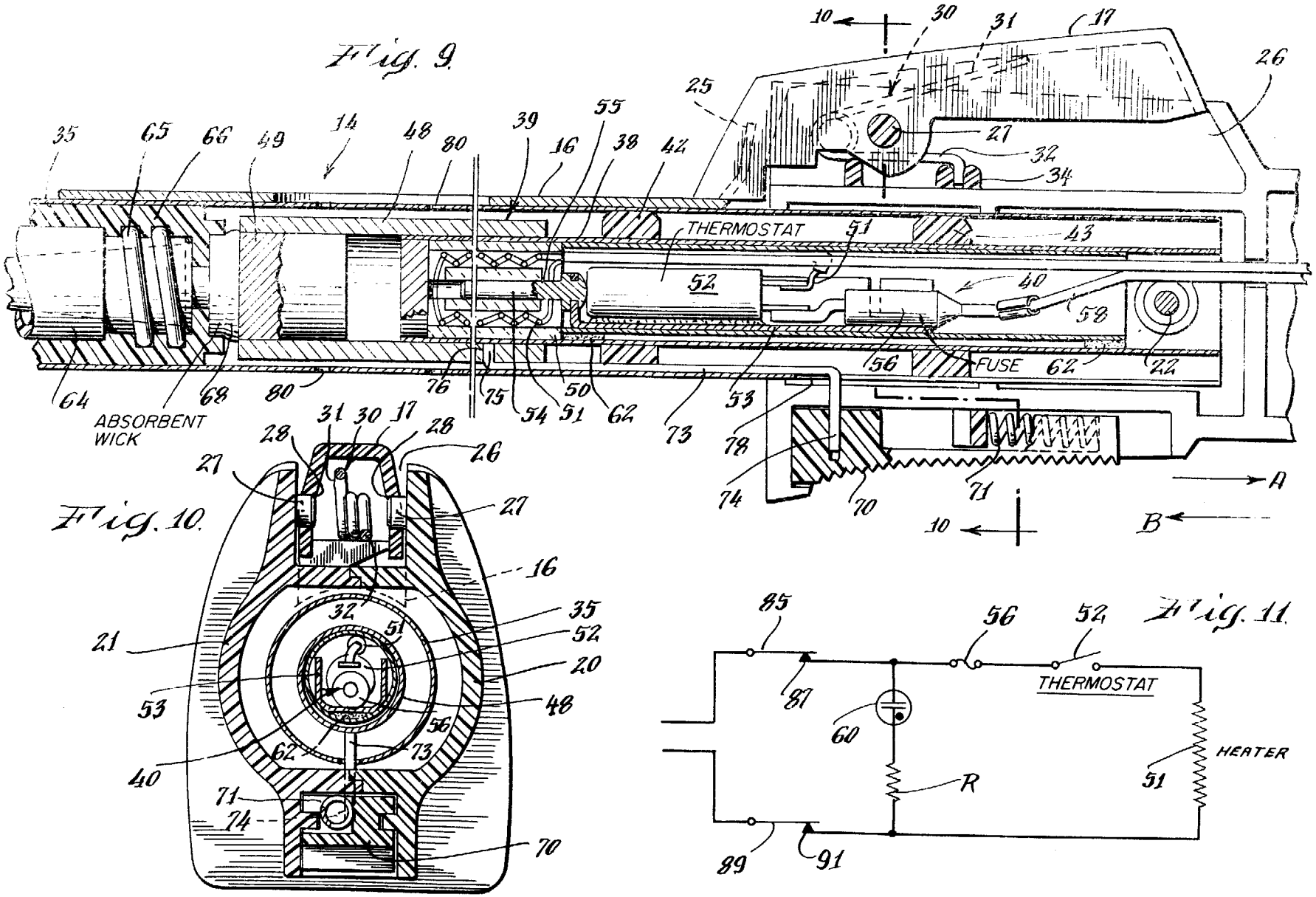
FIG. 9 is an enlarged fragmentary sectional view taken longitudinally through the mid portion of the implement and shows details of the structure thereof.
FIG. 10 is a sectional view taken on the line 10—10 of FIG. 9.
FIG. 11 is a simplified schematic wiring diagram for the device.

A second tubular casing 38 FIGS. 8 and 9 which houses the heat generating means (generally indicated by the reference numeral 39) and the electrical circuit elements (generally indicated by the reference numeral 40) is disposed concentrically within tubular casing 35 and is spaced from the inner wall surfaces of casing 35 by spaced insulating grommets 42–43. A third tubular casing comprising a heat transfer tube 48 is slidably mounted over the leading end of casing 38. An aluminum heat sink member 49 is press fitted into the open end of tube 48 and is normally spaced from heater 39 by the distance established by the engagement of the opposite end of tube 48 with grommet 42 (FIG. 9). As seen in FIGS. 9 and 10 heater element 39 comprises a cylindrical ceramic member 50 having a resistance wire 51 embedded therein. Member 50 is press fitted in tubular casing 38. Additional circuit elements in tube 38 include theremostat 52 and fuse 56 secured to a flanged member 53 which is insulated from tube 38 by suitable spacing insulation such as RTV adhesive indicated at 62 in FIG. 9.

Thermostat 52 is provided with an abutting elongated probe 54 which extends into an axial conduit 55 provided in ceramic member 50. In use when current is applied to iron 10 through power cord 57 (FIGS. 1 to 3) having internal connections with circuit wires 58 through connector 82 in a manner to be explained ceramic heater 50 is heated by resistance wire 51 in a usual manner to heat tube 48 and the outer surface of operative end 14. Thermostat 52 controls a suitable cut-off temperature with probe 54 sensing the heat the length of ceramic member 50 insuring uniform heat throughout. Additional circuit elements include an indicator light 60 to advise the user that iron 10 is operative.

As mentioned it is a feature of the present invention to provide vapor or steam generating means for iron 10. To this end a liquid storage reservoir comprising a bottle member 64 detachably secured to casing 35 by threaded connections 65 thereon in a socket 66 provided in casing 35. An absorbent wick 68 having one end extending into bottle 64 and the opposite end into casing 35 is provided for transmitting liquid from bottle 64 to heater 39.

In order to generate steam actuator means are provided for moving transfer tube 48 whereby heat sink element 49 is moved into contact with wick 68 i.e., from the disengaged position shown in FIG. 5 to the engaged position shown in FIG. 9. The actuator means include an actuator button 70 on the under surface of handle 12. A coil spring 71 (FIG. 9) is disposed within actuator button 70 urging button 70 in the direction of arrow A in FIG. 9. An actuator bar 73 having one end 74 secured to button 70 and the opposite end 75 press fitted in a slot 76 in tube 48. An elongated slot 78 (FIG. 2) is provided in handle 12 to allow for movement of bar 73 when button 70 is moved in the direction of arrow B (FIG. 9). Movement of button 70 in the direction of arrow B will cause actuator bar 73 to drive tube 48 longitudinally of outer casing 35. In this manner heat sink 49 engages wick 68. Under conditions where wick 68 is moist and heat sink 49 heated by element 50 steam will be generated for release through openings 80 in casing 35. As will be appreciated bottle 64 is readily accessible for filling with liquid by removing it from socket 66, filling it with liquid and then refastening it to socket 66. Release of button 70 causes coil spring 71 to restore tube 48 to the position of FIG. 5 whereat heat sink 49 is disengaged from wick 68.

It is also a feature of this invention to permit connector 82 of power cord 57 to be free for swivel movement so as not to interfere with the use of iron 10 when hair is curled about end 14. To this end connector 82 includes a reduced diameter portion 83 fitted within a circular recess 84 formed in handle 12. Electrical contact is established by connector 82 by means of a first ring output metallic conducting member 85 fitted about a shaft portion 86 of connector 82 having contact with a fixed input contact 87 fixed to a terminal board 88 in handle 12. A second ring output terminal 89 is secured to shaft 86 and which contact 89 is spaced from contact 85 by insulated portion 90 of shaft 86. A second input contact 91 on board 88 engages ring contact 89. The ends of contacts 85 and 89 extend into connector 82 and have soldered connections 93 and 94 with the wires of power cord 57.

In a similar manner contacts 87 and 91 are connected to wires 58 in circuit with the electrical elements 40 as previously described. As will be appreciated rotation of handle 12 permits connector 82 to swivel about the walls of recess 84. Input contacts 87–91 remain in sliding electrical contact with output contacts 85–89 as the handle 12 is rotated without breaking the circuit connection.

The electrical elements 40 are schematically illustrated in circuit in FIG. 11. Heating element 50 is in parallel with indicator light 60 which is provided with protective resistor R. Thermostat 52 is in line with fuse 56 and heater 50 to control the selected temperature of heater 50. Cord contacts 85–89 are shown in circuit establishing connection with input contacts 87–91.

As will be appreciated from the foregoing description curling iron 10 has many advantages in use. By holding handle 12 a user can without changing positions of the hand manipulate the hair clip 16 to clamp a tuft of hair to the operative end 14 and at the same time with the remaining fingers manipulate actuator button 70 to move casing 48 to engage heat sink 49 with wick 68 and generate steam for transmission outwardly of the steam outlets 80 in operative end 14. The novel connector 82 connection further permitting ready swivel movement at the handle.

Although one embodiment of the invention has been illustrated and described in detail, it is to be expressly understood that the invention is not limited thereto. Various changes can be made in the design and arrangement of parts without departing from the spirit and scope of the invention as the same will now be understood by those skilled in the art.

What is claimed is:

1. An electric hair curling iron including means for selective generation of liquid vapors for styling the hair of the user therewith, comprising:

a. a handle casing and a hair curling body extending therefrom, said hair curling body including a heating chamber therein having openings in communication with an exterior surface of said body, b. stationary heat generating means arranged in said handle casing and said body, c. movable heat conducting means within said body disposed to receive heat from said stationary heat generating means, d. liquid storage means spaced from said handle casing and at one end of said hair curling body and including liquid transfer means in communication with the liquid storage means, e. said liquid transfer means being spaced from said movable heat conducting means to define therebetween a vaporization space within said heating chamber, said openings communicating with said vaporization space and f. actuator means carried by the handle casing and operably associated with said movable heat conducting means for selectively bringing said movable heat conducting means into and out of engagement with said liquid transfer means to effect generation of vapors from the liquid in the liquid transfer means, whereby, vapors are formed in said vaporization space and pass exteriorly through said openings in the hair curling body.

2. The electric hair curling iron of claim 1, wherein said hair curling body includes, a. an outer tubular member having said openings therethrough, one end of said tubular member being secured within said handle casing and an opposite end supporting said liquid storage means, b. a stationary inner tubular member arranged within said outer member and having disposed therein said stationary heat generating means, and c. means supporting said movable heat conducting means on said inner tubular member for relative axial movement thereon.

3. The electric hair curling iron of claim 2, wherein said movable heat conducting means includes a tubular support member slidably mounted on said inner tubular member for relative axial movement thereon, a heat sink member disposed at one end of said support member and normally spaced from and in alignment with said liquid transfer means.

4. The electric hair curling iron of claim 1, wherein said stationary heat generating means includes an elongated electrical resistance heating member co-extensive with a portion of said hair curling body, a. a thermostat in series circuit with said heating member for controlling electrical energization thereof, b. said thermostat having a heat sensing probe arranged within said heating member and disposed to receive heat from a major portion of the length of said elongated heating member, and c. said heat sensing probe communicating the heat received from the length of said heating member to said thermostat to effect said energization control of the heating member, thereby maintaining a uniform heat level over a major portion of said hair curling body.

5. The hair curling iron of claim 4, wherein said thermostat is arranged within an inner tubular member in alignment with one end of said heating member and said probe extends from said thermostat into said heating member.

6. The electric hair curling iron of claim 1, wherein said handle casing actuator means includes a finger-operable actuator member movably mounted on an outer surface of said handle casing, and means connecting said actuator member to said movable heat conducting means to bring the latter into contact with said liquid transfer means upon operation of said actuator member.

7. The electric hair curling iron of claim 6, wherein said handle casing includes a hair clamp mounted for pivotal movement thereon and having means for pivoting said hair clamp toward and away from said hair curling body, and said actuator member includes a spring urged button on said handle casing outer surface located 180° from said hair clamp pivoting means.

* * * * *